US008052234B2

(12) United States Patent
Liang et al.

(10) Patent No.: US 8,052,234 B2
(45) Date of Patent: Nov. 8, 2011

(54) SLIDE ADJUSTING DEVICE FOR A DRAWER

(75) Inventors: Hsiu-Chiang Liang, Kaohsiung Hsien (TW); Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 441 days.

(21) Appl. No.: 12/382,453

(22) Filed: Mar. 17, 2009

(65) Prior Publication Data

US 2009/0236959 A1 Sep. 24, 2009

(30) Foreign Application Priority Data

Mar. 21, 2008 (TW) ..... 97110279 A

(51) Int. Cl.
*A47B 88/00* (2006.01)

(52) U.S. Cl. ..... 312/334.4; 312/350

(58) Field of Classification Search ..... 312/334.4, 312/334.5, 330.1, 350; 384/22
See application file for complete search history.

(56) References Cited

U.S. PATENT DOCUMENTS 5,439,283 A * 8/1995 Schroder et al. ..... 312/334.4
5,580,139 A 12/1996 Grabher
5,664,855 A * 9/1997 Lautenschlager et al. . 312/334.4
6,913,334 B2 * 7/2005 Weichelt ..... 312/334.4
6,945,618 B2 * 9/2005 Kim et al. ..... 312/334.4
7,226,139 B2 6/2007 Salice
7,695,080 B2 * 4/2010 Chen et al. ..... 312/333
2001/0019235 A1 * 9/2001 Hammerle ..... 312/334.4
2004/0095047 A1 5/2004 Salice
2005/0231083 A1 10/2005 Garcie
2008/0303397 A1 12/2008 Chen et al.
2009/0236959 A1 * 9/2009 Liang et al. ..... 312/334.4
2011/0129171 A1 * 6/2011 Liang et al. ..... 384/22

* cited by examiner

*Primary Examiner* — Janet M Wilkens
*Assistant Examiner* — Daniel Rohrhoff
(74) *Attorney, Agent, or Firm* — Rosenberg, Klein & Lee

(57) ABSTRACT

A slide adjusting device for a drawer includes a first rail member having a first opening; a fixture secured to the first rail member; a supporting member including a connecting portion, a supporting portion, and a guiding portion, the connecting portion being connected to the fixture, the supporting portion corresponding in position to the first opening, the guiding portion comprising a guiding surface, the fixture or the supporting member being provided with a plurality of first engaging portions; an adjusting member including an adjusting portion and a connecting rod driven by the adjusting portion, the connecting rod being provided with a plurality of second engaging portions. When the adjusting portion is turned, the second engaging portions will be driven to move and mesh with the first engaging portions and the supporting portion will move in relation to the first opening with the connecting portion as a fulcrum to hold against the bottom of the drawer.

12 Claims, 11 Drawing Sheets

SLIDE ADJUSTING DEVICE FOR A DRAWER

BACKGROUND OF THE INVENTION

1. Field of the Invention

The present invention relates to a slide adjusting device for a drawer, and more particularly to one which is able to adjust the height of the drawer in relation to the slide.

2. Description of the Prior Art

A slide adjusting device for a drawer has been disclosed, such as U.S. Pat. No. 7,226,139 titled "device for adjusting the height of a drawer"; U.S. Pat. No. 5,439,283 titled "adjustment device to align a drawer"; U.S. Pat. No. 5,580,139 titled "device for fixing a drawer extension mechanism"; U.S. Pat. No. 6,913,334 titled "device for establishing a detent connection"; U.S. Pat. No. 6,945,618 titled "drawer slide adjustment mechanism"; U.S. Published Application No. 2004/0095407 titled "device for connecting a draw-out rail of a drawer guide set to a drawer"; and U.S. Published Application No. 2005/0231083 titled "undermount drawer slide".

U.S. Pat. Nos. 7,226,139; 5,439,283; 5,580,139; 6,913,334; and U.S. Published Application No. 2004/0095047 all use a spaced gear teeth structure as a locating means, but they are unable to do a fine adjustment due to the spaced distance of the gear teeth. U.S. Pat. No. 6,945,618 and U.S. Published Application No. 2005/0231083 require a tool to do the adjustment, which is not convenient to the user.

SUMMARY OF THE INVENTION

The objective of the present invention is to provide a slide adjusting device for a drawer which enables a user to adjust the height of the drawer and provides a positioning function after adjustment.

According to a first aspect of the present invention, there is provided a slide adjusting device for a drawer, comprising:

a first rail member, disposed at a bottom of the drawer, the first rail member comprising a pair of side walls connected by an extension wall, a first channel being defined among the pair of side walls and the extension wall, the extension wall having a first end portion, the first end portion being formed with a first opening;

a fixture, fixedly connected to the first end portion of the first rail member, the fixture comprising a connecting surface, the connecting surface comprising a plurality of first engaging portions;

a supporting member, comprising a connecting portion, a supporting portion, and a guiding portion, the connecting portion being connected to the fixture, the supporting portion corresponding in position to the first opening of the first rail member, the guiding portion corresponding in position to the supporting portion, the guiding portion comprising a guiding surface, the guiding surface having a first guiding end and a second guiding end opposite to the first guiding end, the first guiding end and the second guiding end having different vertical distances in relation to the first rail member; and an adjusting member, comprising an adjusting portion and a connecting rod driven by the adjusting portion, the connecting rod having two ends each provided with a plurality of second engaging portions for meshing with the first engaging portions of the connecting surface, the connecting rod corresponding to the guiding surface, when the adjusting portion is turned by a user, the second engaging portions at the two ends of the connecting rod moving and meshing with the first engaging portions of the connecting surface, the connecting rod holding against the guiding portion of the supporting member, the supporting portion of the supporting member moving in relation to the first opening of the first rail member with the connecting portion as a fulcrum to hold against the bottom of the drawer.

According to a second aspect of the present invention, there is provided a slide adjusting device, comprising:

a first rail member, having a first opening;

a fixture, secured to the first rail member, the fixture comprising a connecting surface, the connecting surface comprising a plurality of first engaging portions;

a supporting member, comprising a connecting portion, a supporting portion, and a guiding portion, the connecting portion being connected to the fixture, the supporting portion corresponding in position to the first opening of the first rail member, the guiding portion corresponding in position to the supporting portion, the guiding portion comprising a guiding surface, the guiding surface having a first guiding end and a second guiding end opposite to the first guiding end, the first guiding end and the second guiding end having different vertical distances in relation to the first rail member; and an adjusting member, comprising an adjusting portion and a connecting rod driven by the adjusting portion, the connecting rod having two ends each provided with a plurality of second engaging portions for meshing with the first engaging portions of the connecting surface, the connecting rod corresponding to the guiding surface, when the adjusting portion is turned by a user, the second engaging portions at the two ends of the connecting rod moving and meshing with the first engaging portions of the connecting surface, the connecting rod holding against the guiding portion of the supporting member, the supporting portion of the supporting member moving in relation to the first opening of the first rail member with the connecting portion as a fulcrum.

According to a third aspect of the present invention, there is provided a slide adjusting device, comprising:

a first rail member, having a first opening;

a fixture, secured to the first rail member;

a supporting member, comprising a connecting portion, a supporting portion, and a guiding portion, the connecting portion being connected to the fixture, the supporting portion corresponding in position to the first opening of the first rail member, the guiding portion corresponding in position to the supporting portion, the guiding portion comprising a guiding surface, the guiding surface being formed with a plurality of first engaging portions, the guiding surface having a first guiding end and a second guiding end opposite to the first guiding end, the first guiding end and the second guiding end having different vertical distances in relation to the first rail member; and an adjusting member, comprising an adjusting portion and a connecting rod driven by the adjusting portion, the adjusting portion being adapted for a user to operate, the connecting rod being provided with a plurality of second engaging portions for meshing with the first engaging portions of the supporting member, when the adjusting portion is turned by the user, the second engaging portions of the connecting rod moving and meshing with the first engaging portions of the supporting member, the supporting portion of the supporting member moving in relation to the first opening of the first rail member with the connecting portion as a fulcrum.

According to a fourth aspect of the present invention, the connecting portion of the supporting member is connected the first rail member.

The present invention has the following advantages:

1. the drawer is adjustable for its height; and
2. the drawer is positioned in place after adjustment, and the adjustment is stepless.

DETAILED DESCRIPTION OF THE PREFERRED EMBODIMENTS

Figure 1:
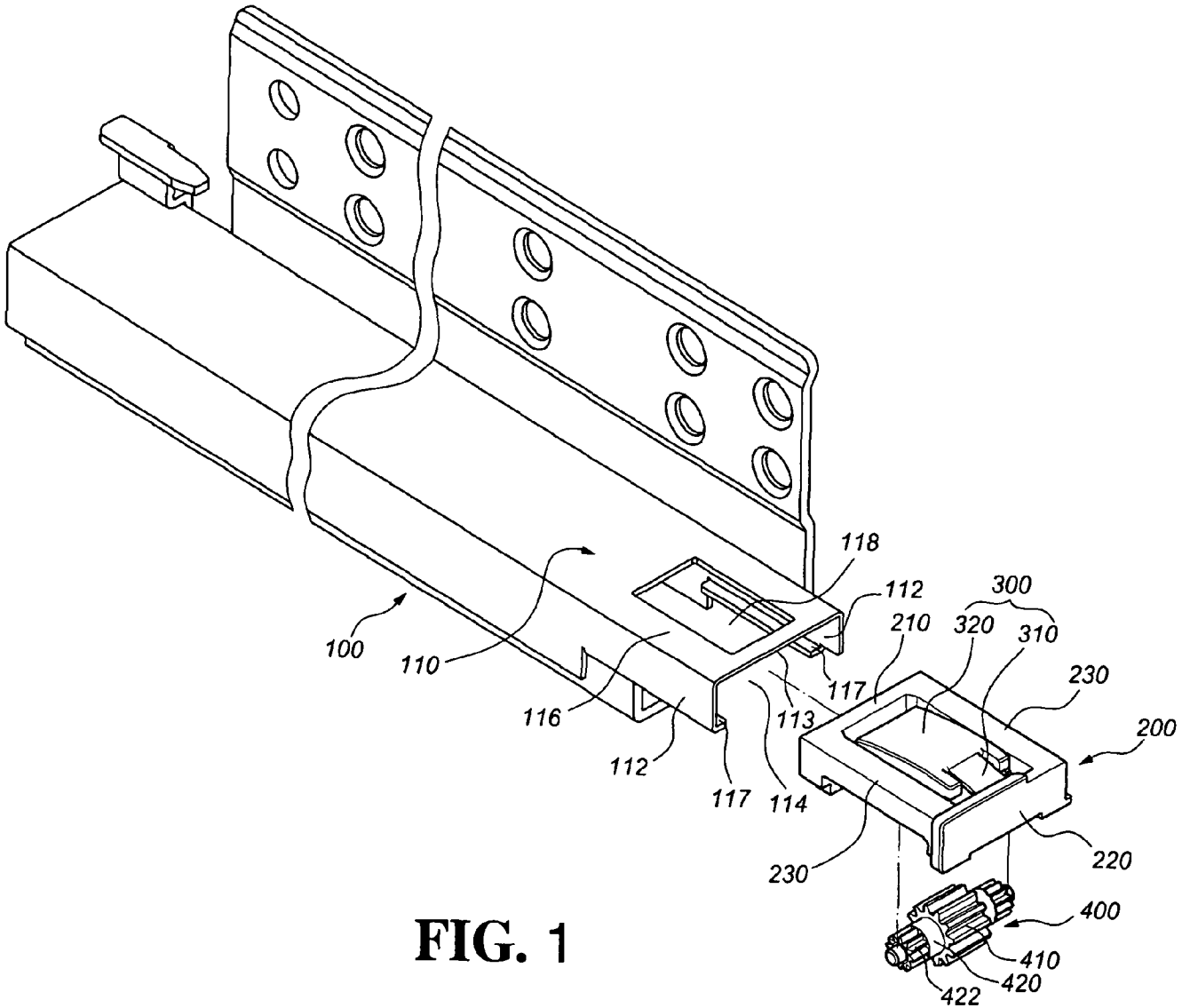
FIG. 1 is an exploded view of a slide adjusting member according to a first preferred embodiment of the present invention.

FIG. 1 is an exploded view of a slide adjusting device for a drawer according to a first preferred embodiment of the present invention. A slide assembly 100 comprises a first rail member 110 to be coupled to a bottom of a drawer 500 (referring to FIG. 6) such that the drawer 500 is able to slide with the first rail member 110. The first rail member 110 comprises a pair of side walls 112 connected by an extension wall 113. A first channel 114 is defined among the pair of side walls 112 and the extension wall 113. The extension wall 113 has a first end portion 116. The first end portion 116 is formed with a first opening 118.

In this embodiment, the slide adjusting device comprises a fixture 200, a supporting member 300 and an adjusting member 400.

The fixture 200 comprises a first fixing portion 210, a second fixing portion 220, and a connecting member 230 between the first fixing portion 210 and the second fixing portion 220.

The supporting member 300 comprises a connecting portion 310 and a supporting portion 320. The connecting portion 310 is connected to the second fixing portion 220 of the fixture 200. The supporting portion 320 corresponds in position to the first opening 118. In this embodiment, the connecting portion 310 of the supporting member 300 is integrally formed with the second fixing portion 220 of the fixture 200.

The adjusting member 400 corresponds in position to the supporting member 300, and comprises an adjusting portion 410 and a connecting rod 420 driven by the adjusting portion 410. The connecting rod 420 comprises a plurality of second engaging portions 422 at two ends thereof. In this embodiment, the second engaging portions 422 are gear teeth arranged in a circle shape.

Figure 2:
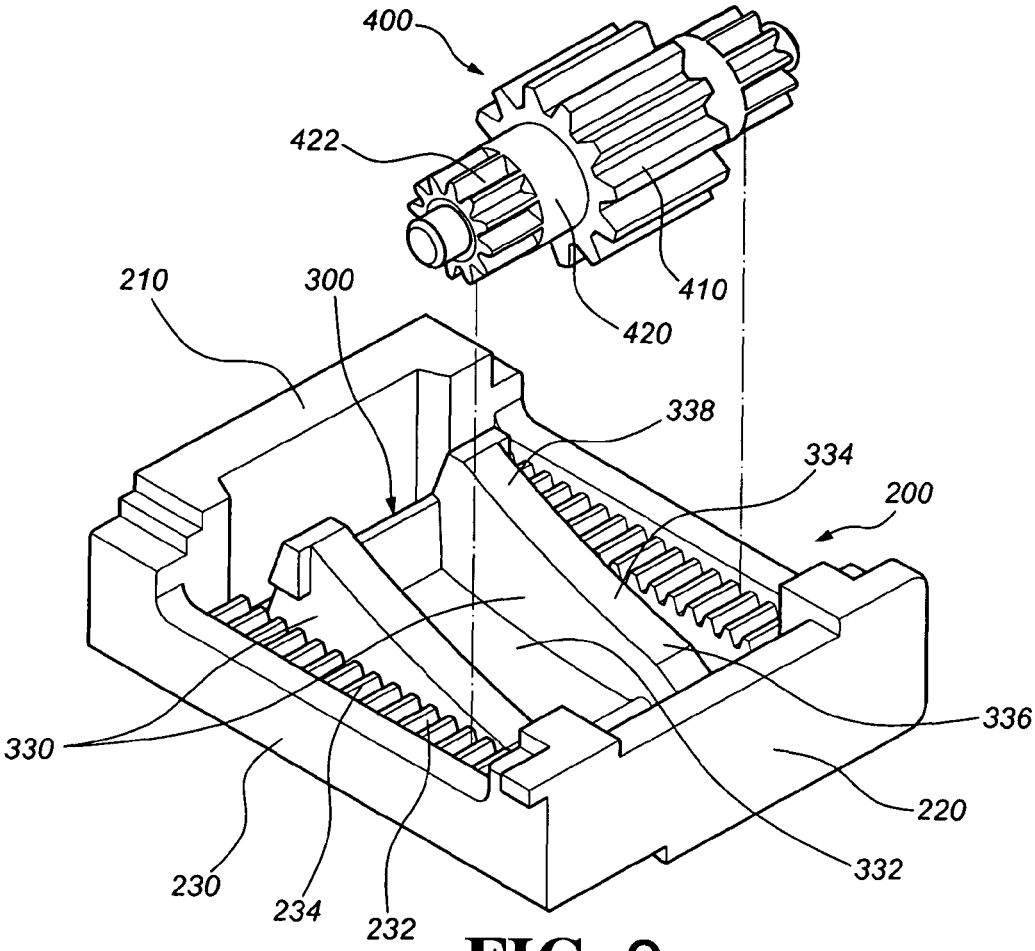
FIG. 2 is an exploded view of a fixture and an adjusting member according to the first preferred embodiment of the present invention.

FIG. 2 is an exploded view of the fixture 200 and the adjusting member 400 according to the first preferred embodiment of the present invention. The connecting member 230 of the fixture 200 is provided with a connecting surface 232 having a plurality of first engaging portions 234 thereon. In this embodiment, the first engaging portions 234 are gear teeth. The supporting member 300 further comprises a guiding portion 330 corresponding in position to the supporting portion 320. The guiding portion 330 comprises a guiding groove 332 and a pair of guiding surfaces 334 at two sides of the guiding groove 332. Each of the guiding surfaces 334 has a first guiding end 336 and a second guiding end 338 opposite to the first guiding end 336. The first guiding end 336 and the second guiding end 338 have different vertical distances in relation to the first rail member 110. In this embodiment, the guiding surfaces 334 of the guiding portion 330 are preset inclined surfaces.

Figure 3:
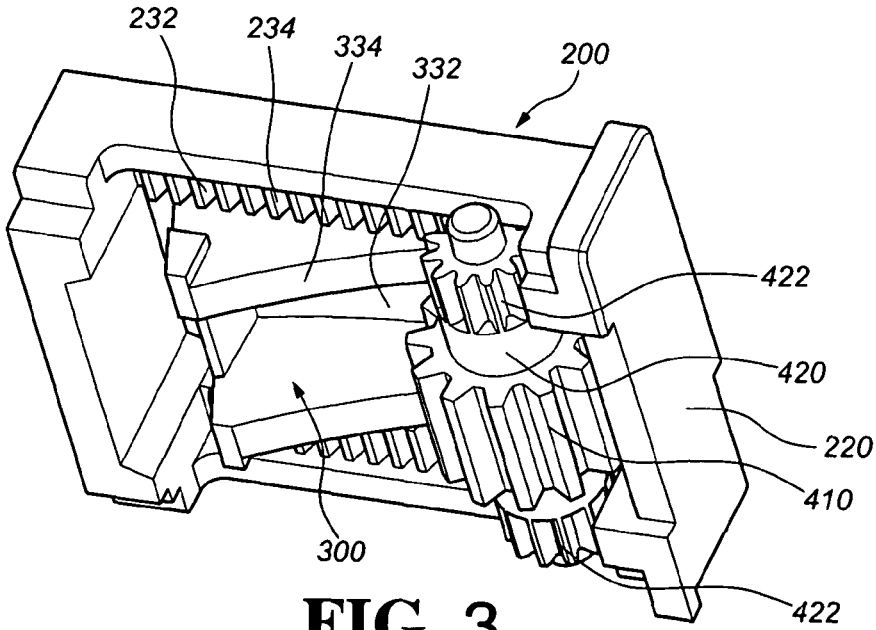
FIG. 3 is a perspective view of the fixture and the adjusting member according to the first preferred embodiment of the present invention.

FIG. 3 is a perspective view showing the assembly of the fixture 200 and the adjusting member 400 according to the first preferred embodiment of the present invention. The adjusting member 400 is connected to the fixture 200, with the second engaging portions 422 meshing with the first engaging portions 234 of the connecting surface 232. The adjusting portion 410 corresponds in position to the guiding groove 332 of the supporting member 300. The connecting rod 420 is located on the guiding surfaces 334. The adjusting portion 410 is adapted for a user to operate. The second engaging portions 422 at the two ends of the connecting rod 420 mesh with the first engaging portions 234 of the fixture 200, and are driven by the adjusting portion 410 to change the meshing position. The supporting portion 320 of the supporting member 300 moves in relation to the first opening 118 of the first rail member 110 with the connecting portion 310 as a fulcrum (not shown in the drawings).

Figure 4:
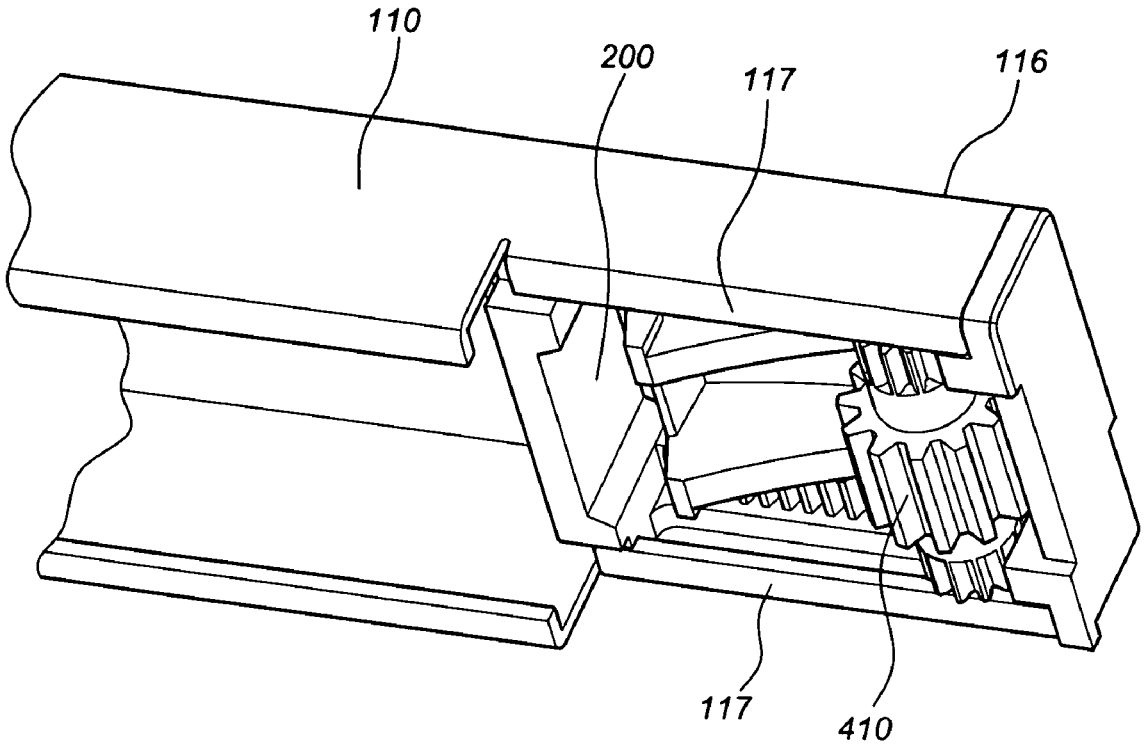
FIG. 4 is a perspective view showing the slide adjusting device coupled to a first rail member according to the first preferred embodiment of the present invention.

FIG. 4 is a perspective view showing the slide adjusting device coupled to the first rail member 110 according to the first preferred embodiment of the present invention. The fixture 200 is secured to the first end portion 116 of the first rail member 110. The adjusting portion 410 has a portion exposed outside the first rail member 110, which is convenient for the user to make an adjustment.

Figure 5:
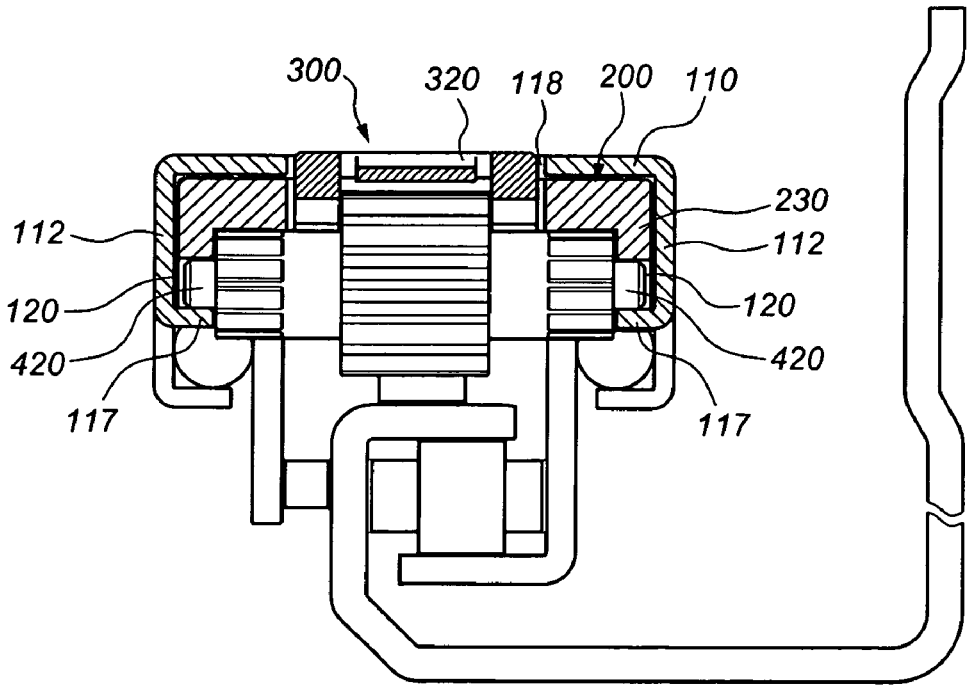
FIG. 5 is a cross-sectional view showing the assembly of the slide adjusting device and the first rail member according to the first preferred embodiment of the present invention.

Referring to FIG. 5, the connecting member 230 of the fixture 200 is tightly engaged with inner sides of the pair of side walls 112 of the first rail member 110. Each side wall 112 comprises a stop portion 117. A second channel 120 is defined between the stop portion 117 and the connecting member 230 for the two ends of the connecting rod 420 to extend therein and to move therealong. The supporting portion 320 of the supporting member 300 corresponds in position to the first opening 118 of the first rail member 110.

Figure 6:
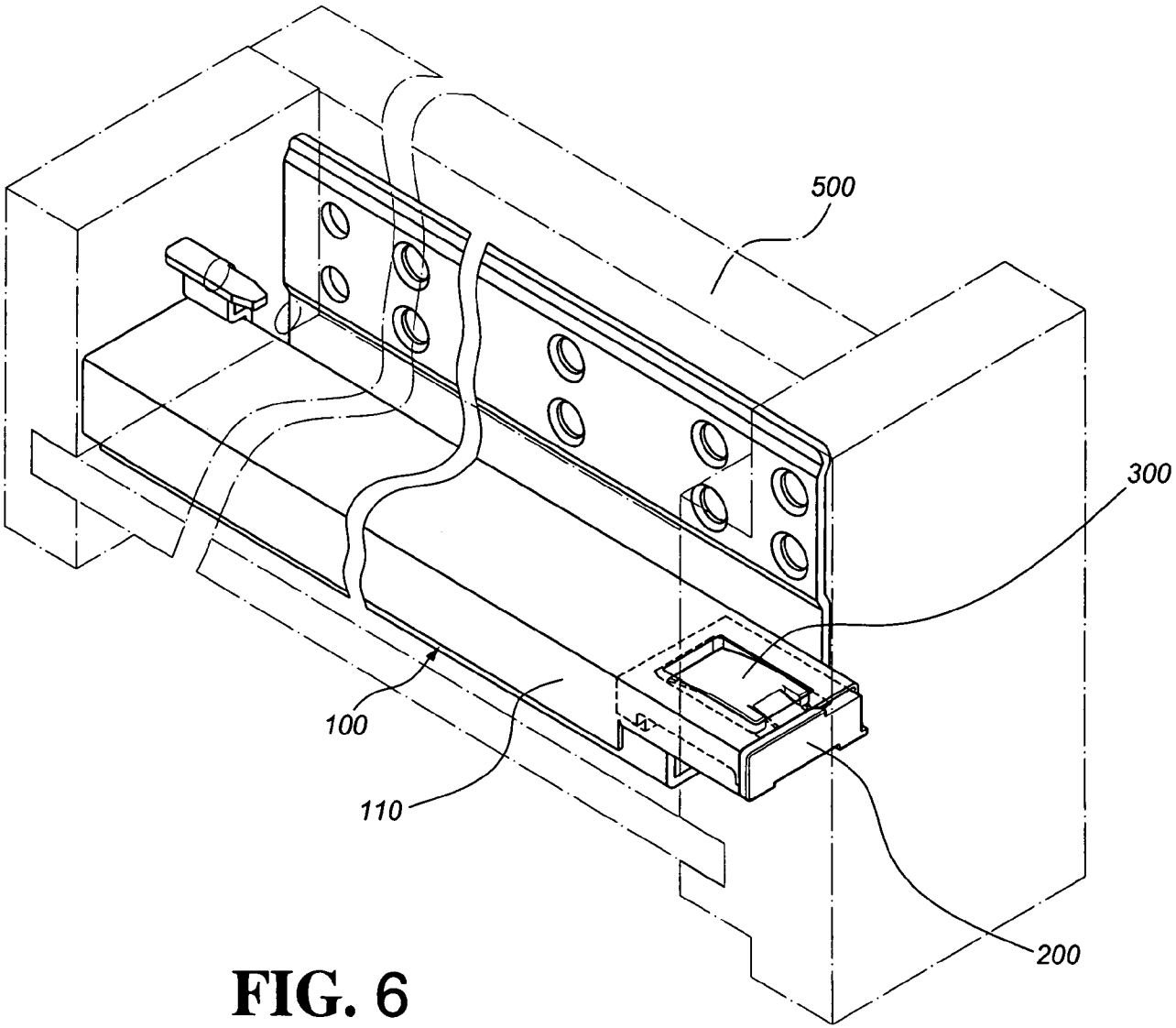
FIG. 6 is a perspective view showing the assembly of the slide adjusting device and a drawer according to the first preferred embodiment of the present invention.

FIG. 6 is a perspective view showing the assembly of the slide adjusting device and the drawer 500 according to the first preferred embodiment of the present invention. The first rail member 110 of the slide assembly 100 is connected to the drawer 500 and located underneath the drawer 500 to facilitate pulling out or pushing back of the drawer 500.

Figure 7:
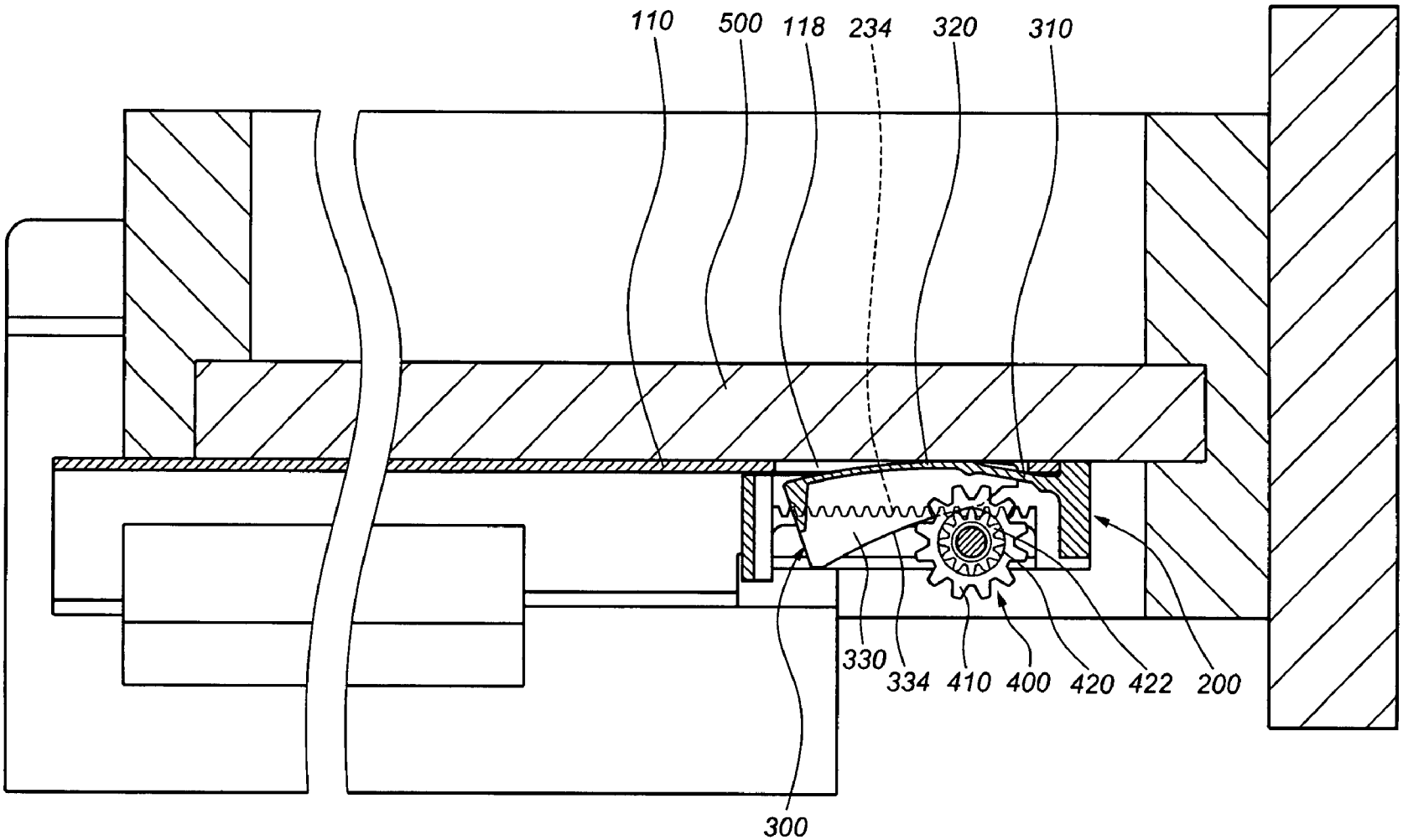
FIG. 7 is a cross-sectional view showing the assembly of the slide adjusting device and the drawer according to the first preferred embodiment of the present invention.

FIG. 7 is a cross-sectional view showing the assembly of the slide adjusting device and the drawer 500 according to the first preferred embodiment of the present invention. The first rail member 110 is secured to the drawer 500. In this embodiment, the first rail member 110 is disposed underneath the drawer 500, with the supporting portion 320 of the supporting member 300 in contact with a bottom surface of the drawer 500.

Figure 8:
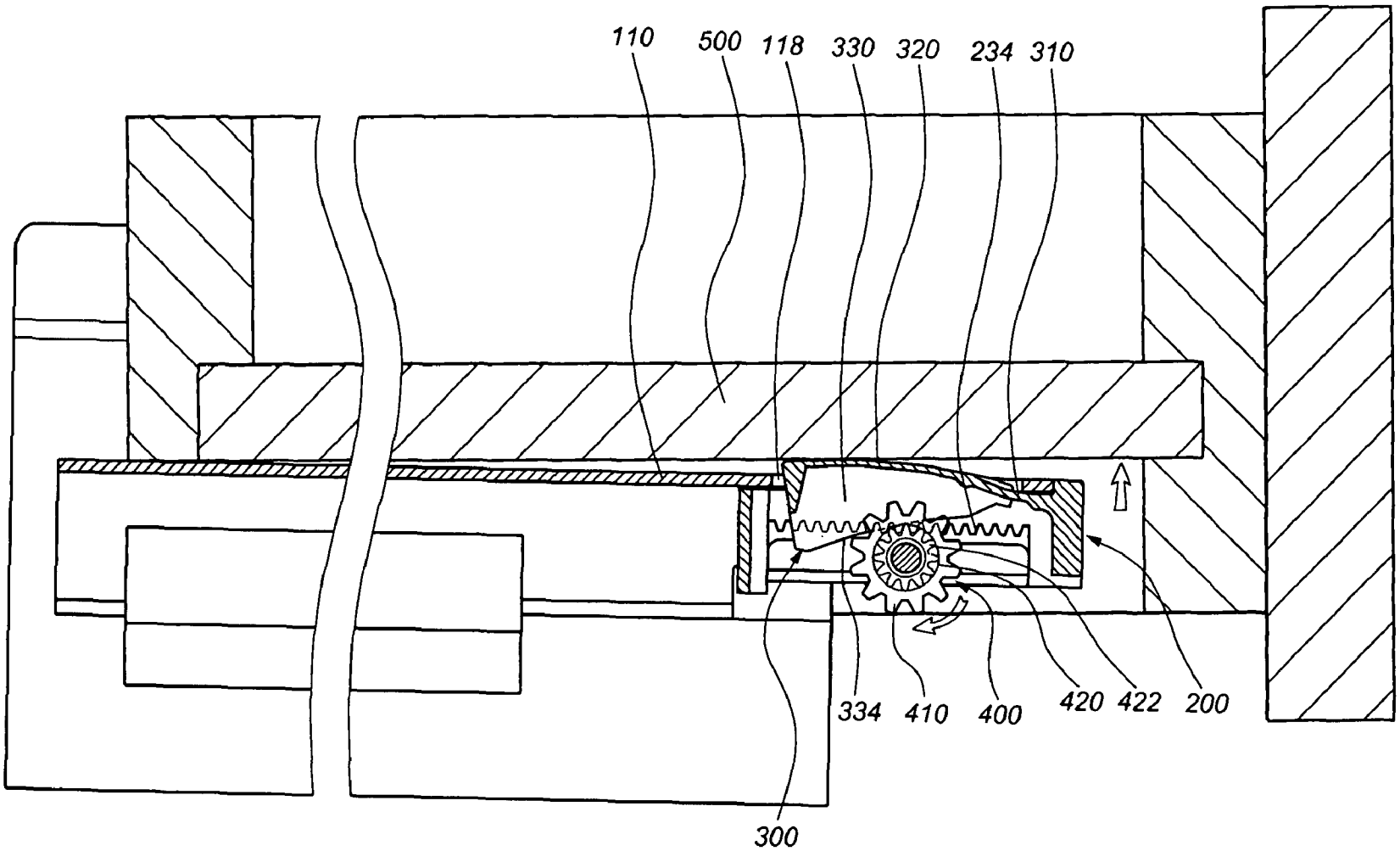
FIG. 8 is cross-sectional view showing the adjustment of the slide adjusting device and the drawer according to the first preferred embodiment of the present invention.

FIG. 8 is a cross-sectional view showing the adjustment of the slide adjusting device and the drawer 500 according to the first preferred embodiment of the present invention. When adjusting the height of the drawer 500, in particular to a front end of the drawer 500, the user may roll the adjusting portion 410 of the adjusting member 400 which links the second engaging portions 422 at the two ends of the connecting rod 420 to turn and mesh with the first engaging portions 234 of the fixture 200. The connecting rod 420 holds against the guiding surfaces 334 of the guiding portion 330 of the supporting member 300 and rolls along the guiding surfaces 334 in relation to the first opening 118 of the first rail member 110, with the connecting portion 310 as the fulcrum. The rolling movement of the connecting rod 420 towards one direction will lift up the bottom of the drawer 500 and another opposite direction will drop down the height of the drawer 500. After adjustment, the height of the drawer 500 provides a positioning function.

Figure 9:
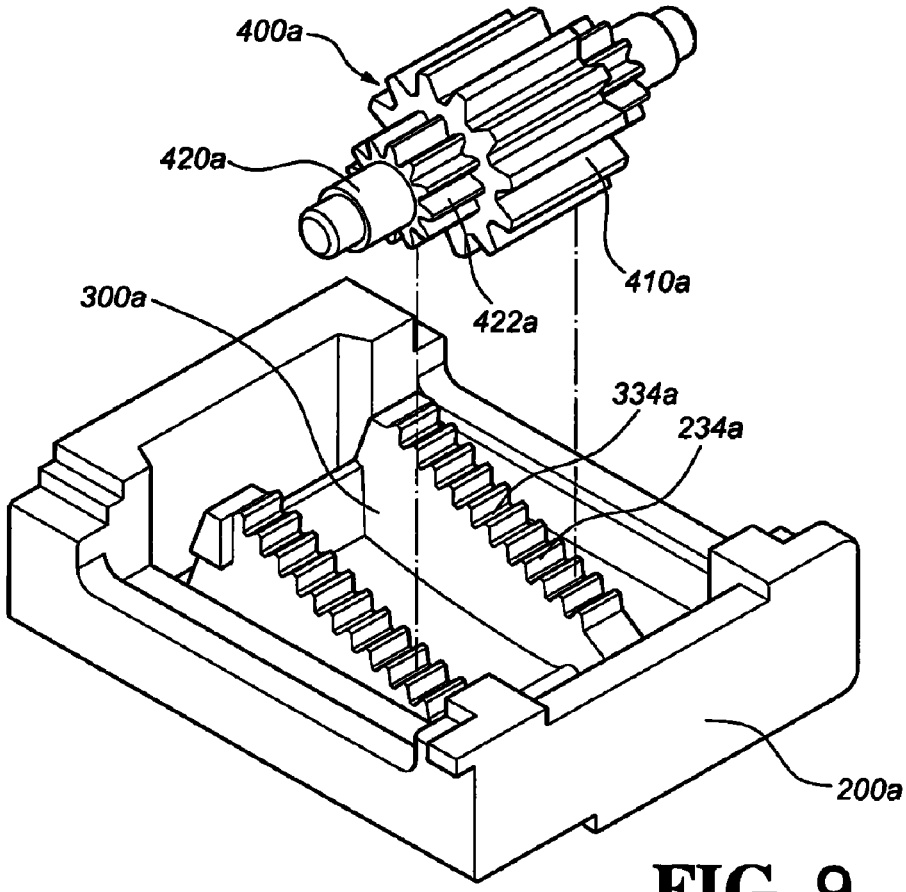
FIG. 9 is an exploded view of the fixture and the adjusting member according to a second preferred embodiment of the present invention.

FIG. 9 is an exploded view of a fixture 200*a* and an adjusting member 400*a* according to a second preferred embodiment of the present invention. The slide adjusting device in the second preferred embodiment is substantially similar to the first preferred embodiment with the exception described hereinafter. Guiding surfaces 334*a* of a supporting member 300*a* are formed with a plurality of first engaging portions 234*a* thereon. A connecting rod 420*a* of the adjusting member 400*a* comprises a plurality of second engaging portions 422*a* corresponding to the first engaging portions 234*a* of the guiding surfaces 334*a* for meshing purpose. Therefore, by rolling an adjusting portion 410*a* of the adjusting member 400*a*, the connecting rod 420*a* is linked to roll which brings the second engaging portions 422*a* to mesh with the first engaging portions 234*a*, thus changing the meshing position. Hence, a supporting portion 320*a* of the supporting member 300*a* may be able to make position change with a connecting portion 310*a* as the fulcrum, referring to FIG. 10.

Figure 10:
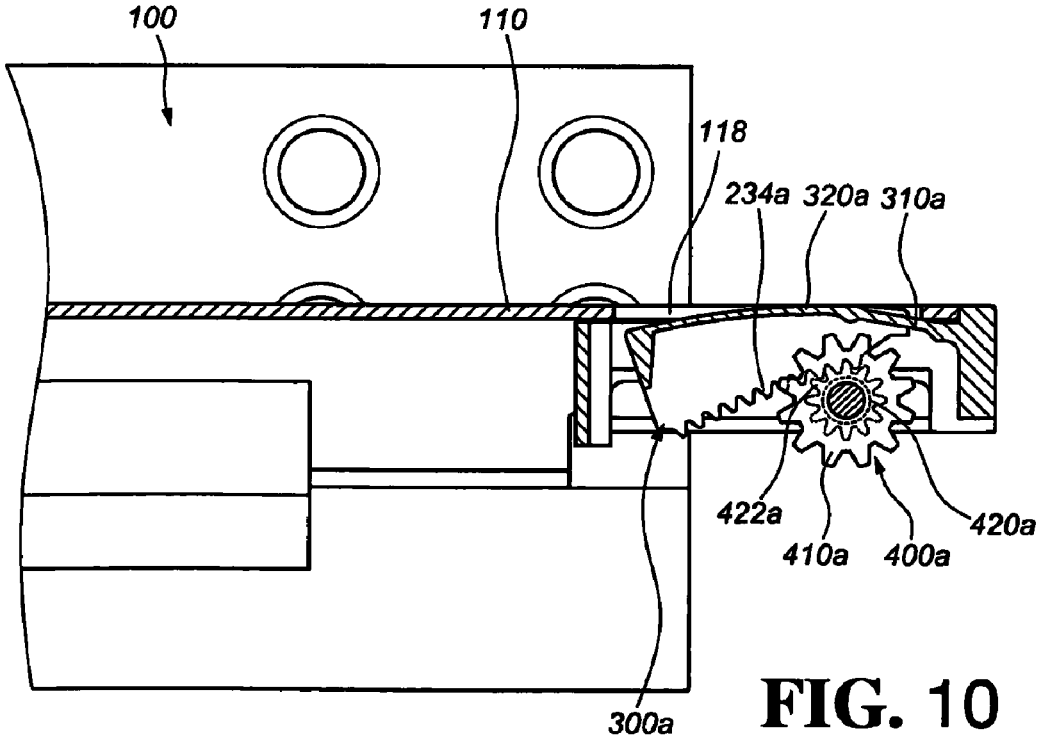
FIG. 10 is a cross-sectional view showing the slide adjusting device coupled to a slide assembly according to the second preferred embodiment of the present invention.

FIG. 10 is a cross-sectional view showing the slide adjusting device coupled to the slide assembly 100 according to the second preferred embodiment of the present invention. By rolling the adjusting portion 410*a* of the adjusting member 400*a*, the supporting portion 320*a* of the supporting member 300*a* is able to move in relation to the first opening 118 of the first rail member 110 with the connecting portion 310*a* as the fulcrum.

Figure 11:
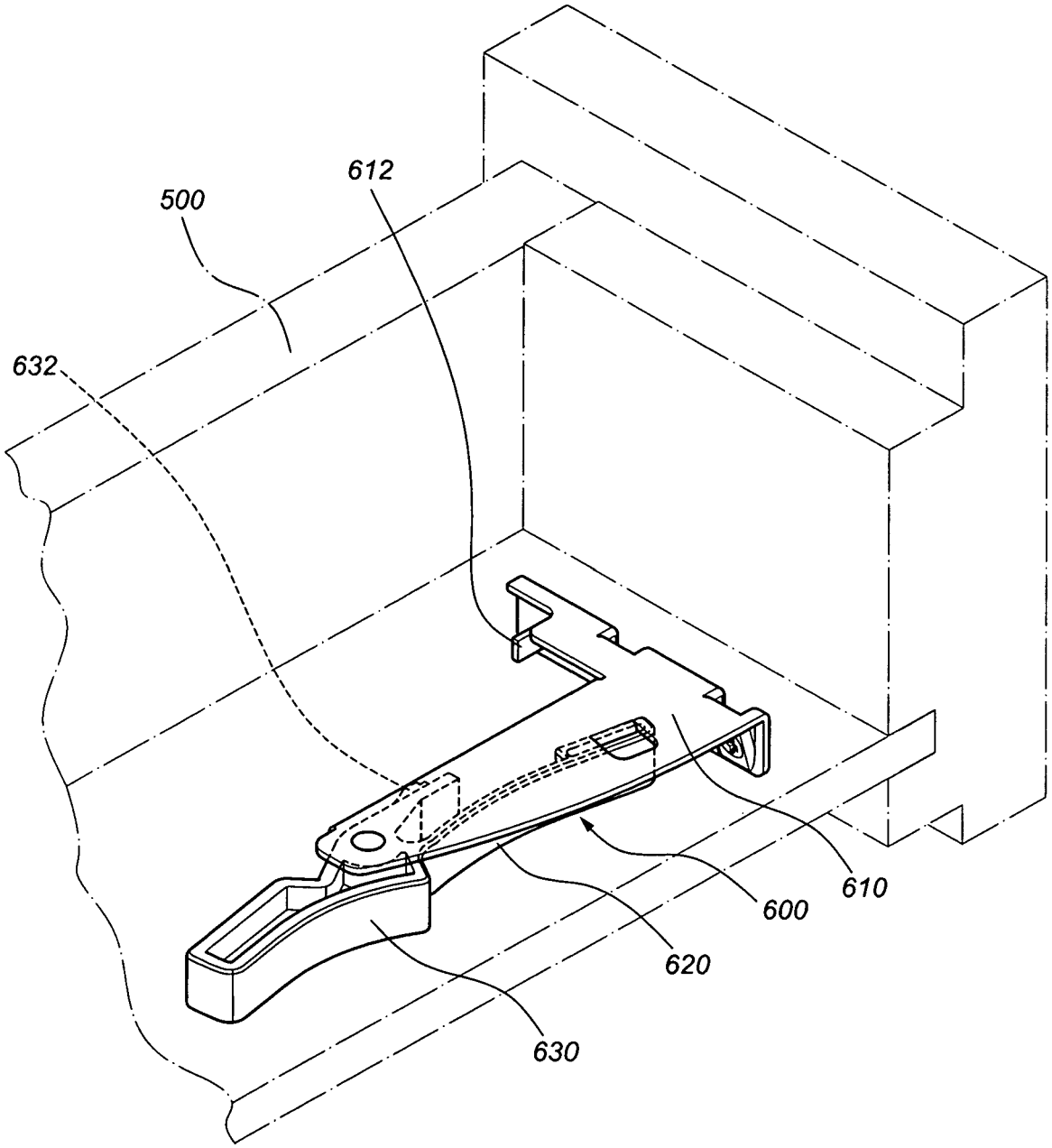
FIG. 11 is a perspective view showing a quick release assembly provided on the bottom of the drawer according to a third preferred embodiment of the present invention.

FIG. 11 is a perspective view showing a quick release assembly 600 provided on the bottom of the drawer 500 according to a third preferred embodiment of the present invention. The quick release assembly 600 comprises a fixing plate 610, a resilient member 620, and an engaging member 630. The engaging member 630 is connected to the fixing plate 610 and is urged by the resilient member 620. The fixing plate 610 is fixedly connected to the bottom of the drawer 500, and comprises a protruding bit 612. The engaging member 630 comprises an engaging block 632.

Figure 12:
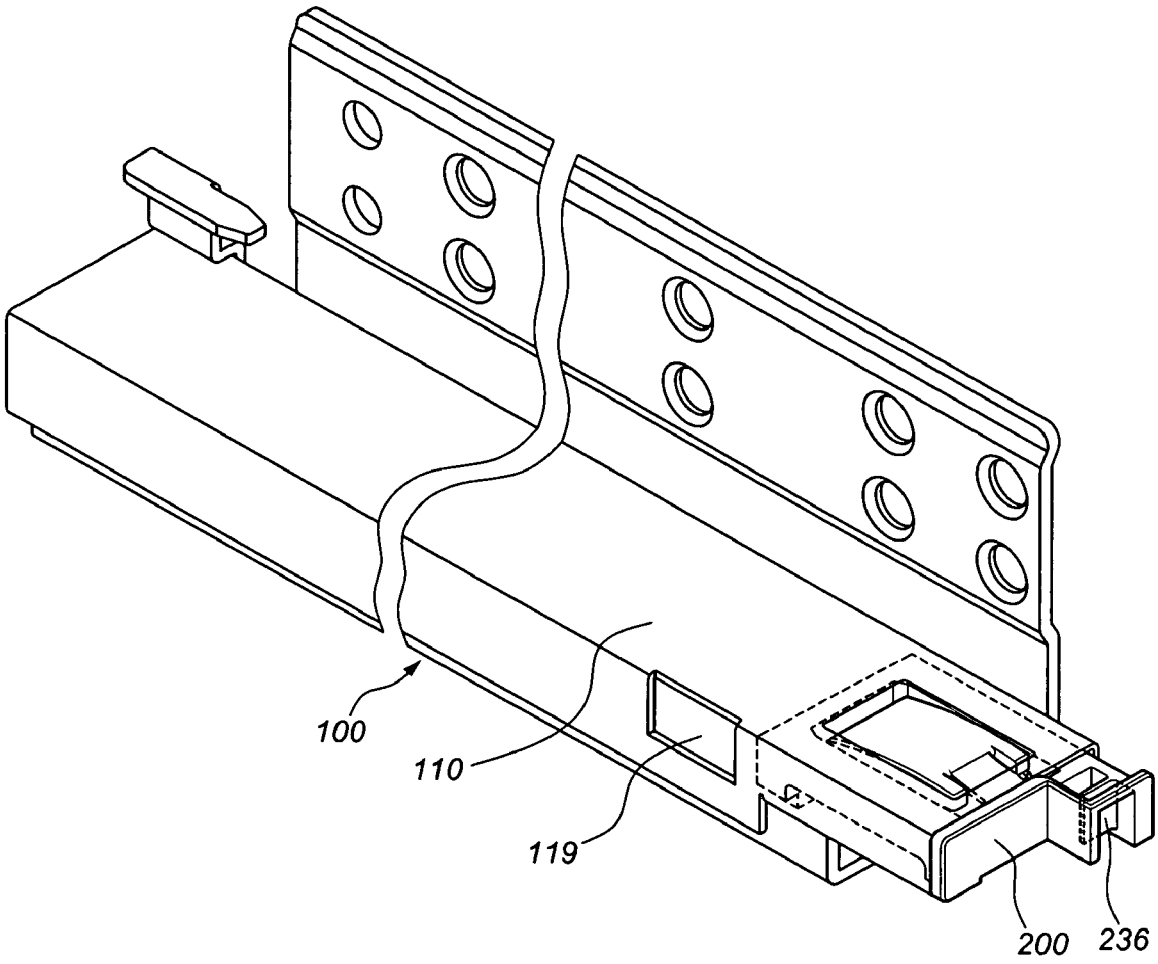
FIG. 12 is a perspective view showing the slide adjusting device coupled to the slide assembly according to the third preferred embodiment of the present invention.

FIG. 12 is a perspective view showing the slide adjusting device coupled to the slide assembly 100 according to the third preferred embodiment of the present invention. In this embodiment, the first rail member 110 is formed with a second opening 119 corresponding to the engaging block 632 of the engaging member 630. The fixture 200 comprises a resilient portion 236 corresponding to the protruding bit 612 of the fixing plate 610 of the quick release assembly 600.

Figure 13:
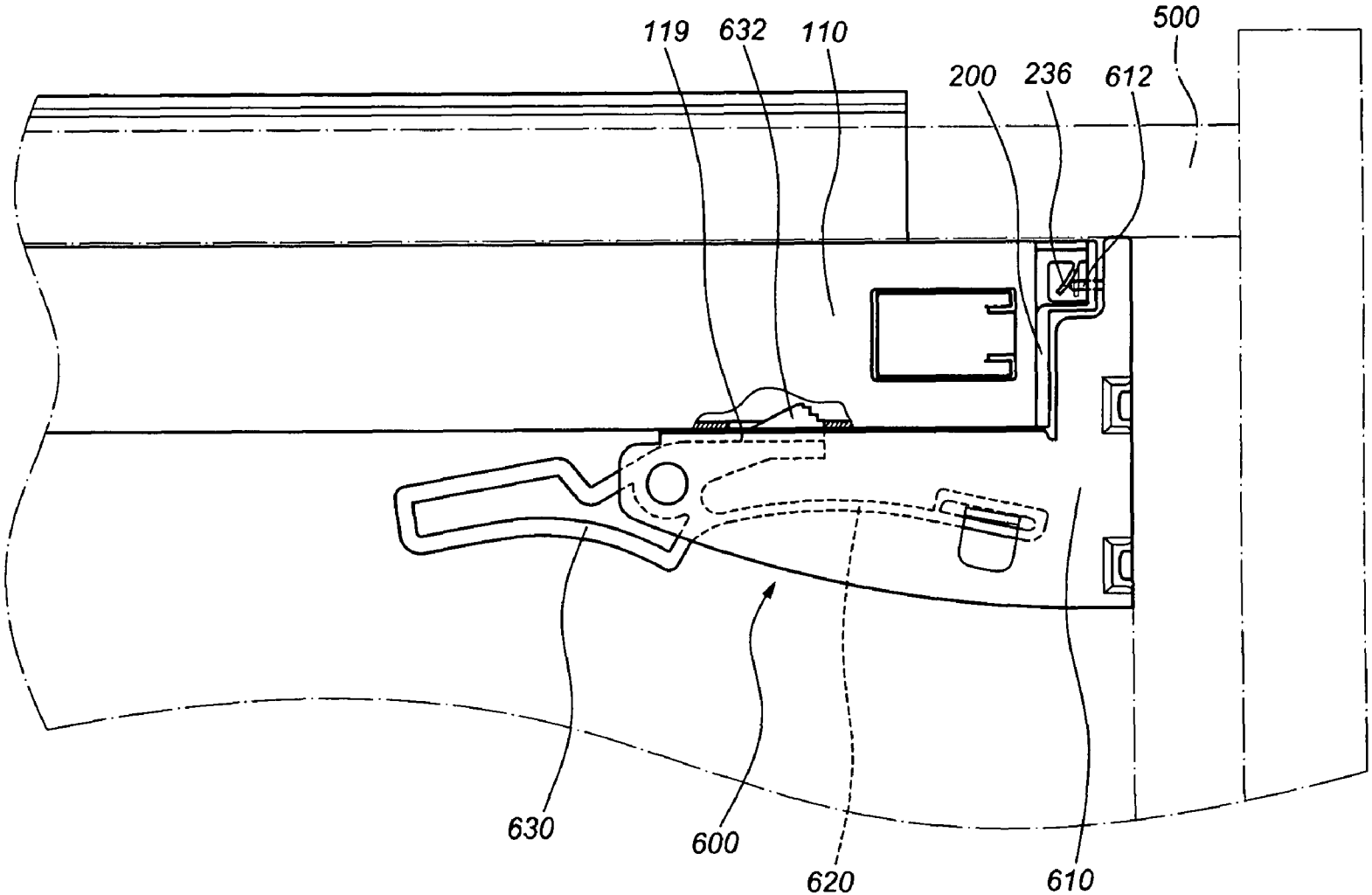
FIG. 13 is a side view showing the assembly of the slide adjusting device and the drawer according to the third preferred embodiment of the present invention.

FIG. 13 is a side view showing the assembly of the slide adjusting device and the drawer 500 according to the third preferred embodiment of the present invention. The drawer 500 is secured to the first rail member 110, in particular, the quick release assembly 600 provided on the drawer 500 has the engaging block 632 of the engaging member 630 engaging with the second opening 119 of the first rail member 110 and the protruding bit 612 of the fixing plate 610 holding against the resilient portion 236 of the fixture 200, so that the drawer 500 and the first rail member 110 are secured together and may be disengaged in a quick manner.

Figure 14:
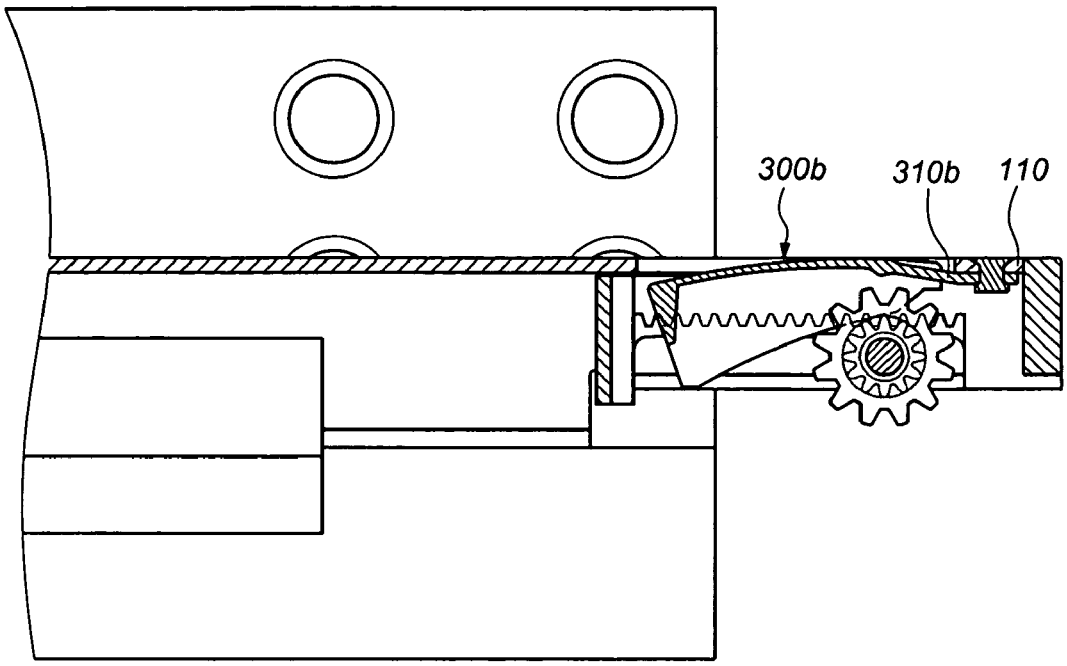
FIG. 14 is a partially enlarged view of the slide adjusting device according to a fourth preferred embodiment of the present invention.

FIG. 14 is a partially enlarged view of the slide adjusting device according to a fourth preferred embodiment of the present invention. The slide adjusting device in the fourth preferred embodiment is substantially similar to the first preferred embodiment with the exception described hereinafter. A connecting portion 310*b* of a supporting member 300*b* is connected to the first rail member 110.

Figure 15:
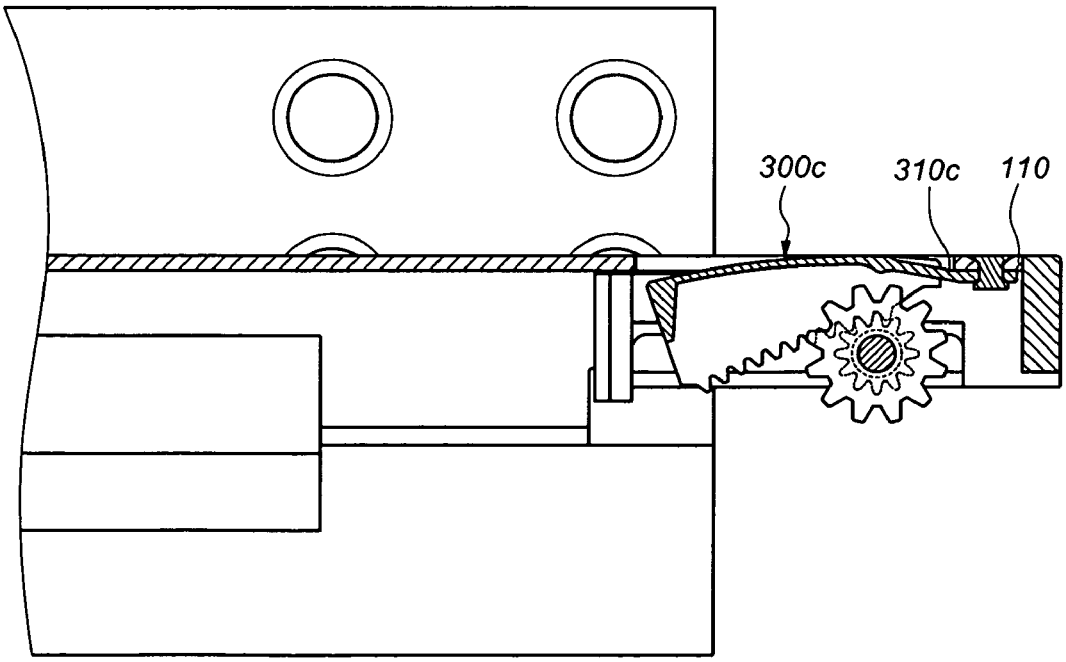
FIG. 15 is a partially enlarged view of the slide adjusting device according to a fifth preferred embodiment of the present invention.

FIG. 15 is a partially enlarged view of the slide adjusting device according to a fifth preferred embodiment of the present invention. The slide adjusting device in the fifth preferred embodiment is substantially similar to the second preferred embodiment with the exception described hereinafter. A connecting portion 310*c* of a supporting member 300*c* is connected to the first rail member 110.

As previous mentioned, the connecting portion of the supporting member is connected to the fixture or the first rail member as a fulcrum for the movement of the supporting member.

What is claimed is:

1. A slide adjusting device for a drawer, comprising:

a first rail member, disposed at a bottom of the drawer, the first rail member comprising a pair of side walls connected by an extension wall, a first channel being defined among the pair of side walls and the extension wall, the extension wall having a first end portion, the first end portion being formed with a first opening;

a fixture, fixedly connected to the first end portion of the first rail member, the fixture comprising a connecting surface, the connecting surface comprising a plurality of first engaging portions;

a supporting member, comprising a connecting portion, a supporting portion, and a guiding portion, the connecting portion being connected to the fixture, the supporting portion corresponding in position to the first opening of the first rail member, the guiding portion corresponding in position to the supporting portion, the guiding portion comprising a guiding surface, the guiding surface having a first guiding end and a second guiding end opposite to the first guiding end, the first guiding end and the second guiding end having different vertical distances in relation to the first rail member; and an adjusting member, comprising an adjusting portion and a connecting rod driven by the adjusting portion, the connecting rod having two ends each provided with a plurality of second engaging portions for meshing with the first engaging portions of the connecting surface, the connecting rod corresponding to the guiding surface, when the adjusting portion is turned by a user, the second engaging portions at the two ends of the connecting rod moving and meshing with the first engaging portions of the connecting surface, the connecting rod holding against the guiding portion of the supporting member, the supporting portion of the supporting member moving in relation to the first opening of the first rail member with the connecting portion as a fulcrum to hold against the bottom of the drawer.

2. The slide adjusting device for a drawer as claimed in claim 1, wherein the fixture comprises a first fixing portion and a second fixing portion, a connecting member being provided between the first fixing portion and the second fixing portion, the connecting member holding against inner sides of the pair of side walls at the first end portion of the first rail member, each of the side walls comprising a stop portion, a second channel being defined between the stop portion and the connecting member.

3. The slide adjusting device for a drawer as claimed in claim 1, wherein the first engaging portions and the second engaging portions are gear teeth to mesh with each other.

4. The slide adjusting device for a drawer as claimed in claim 1, further comprising a quick release assembly, the quick release assembly comprising a fixing plate, a resilient member, and an engaging member, the engaging member being connected to the fixing plate and urged by the resilient member, the fixing plate being secured to the bottom of the drawer, the fixing plate comprising a protruding bit, the first rail member being formed with a second opening, the fixture comprising a resilient portion, the engaging member comprising an engaging block, the engaging block of the engaging member engaging with the second opening of the first rail member, the protruding bit of the fixing plate holding against the resilient portion of the fixture.

5. A slide adjusting device, comprising:

a first rail member, having a first opening;

a fixture, secured to the first rail member, the fixture comprising a connecting surface, the connecting surface comprising a plurality of first engaging portions;

a supporting member, comprising a connecting portion, a supporting portion, and a guiding portion, the connecting portion being connected to the fixture, the supporting portion corresponding in position to the first opening of the first rail member, the guiding portion corresponding in position to the supporting portion, the guiding portion comprising a guiding surface, the guiding surface having a first guiding end and a second guiding end opposite to the first guiding end, the first guiding end and the second guiding end having different vertical distances in relation to the first rail member; and an adjusting member, comprising an adjusting portion and a connecting rod driven by the adjusting portion, the connecting rod having two ends each provided with a plurality of second engaging portions for meshing with the first engaging portions of the connecting surface, the connecting rod corresponding to the guiding surface, when the adjusting portion is turned by a user, the second engaging portions at the two ends of the connecting rod moving and meshing with the first engaging portions of the connecting surface, the connecting rod holding against the guiding portion of the supporting member, the supporting portion of the supporting member moving in relation to the first opening of the first rail member with the connecting portion as a fulcrum.

6. The slide adjusting device as claimed in claim 5, wherein the fixture comprises a first fixing portion and a second fixing portion, a connecting member being provided between the first fixing portion and the second fixing portion, the first rail member further comprising a first end portion and a pair of side walls, the connecting member holding against inner sides of the pair of side walls at the first end portion of the first rail member, each of the side walls comprising a stop portion, a second channel being defined between the stop portion and the connecting member.

7. The slide adjusting device as claimed in claim 5, wherein the first engaging portions and the second engaging portions are gear teeth to mesh with each other.

8. A slide adjusting device, comprising:

a first rail member, having a first opening;

a fixture, secured to the first rail member;

a supporting member, comprising a connecting portion, a supporting portion, and a guiding portion, the connecting portion being connected to the fixture, the supporting portion corresponding in position to the first opening of the first rail member, the guiding portion corresponding in position to the supporting portion, the guiding portion comprising a guiding surface, the guiding surface being formed with a plurality of first engaging portions, the guiding surface having a first guiding end and a second guiding end opposite to the first guiding end, the first guiding end and the second guiding end having different vertical distances in relation to the first rail member; and an adjusting member, comprising an adjusting portion and a connecting rod driven by the adjusting portion, the adjusting portion being adapted for a user to operate, the connecting rod being provided with a plurality of second engaging portions for meshing with the first engaging portions of the supporting member, when the adjusting portion is turned by the user, the second engaging portions of the connecting rod moving and meshing with the first engaging portions of the supporting member, the supporting portion of the supporting member moving in relation to the first opening of the first rail member with the connecting portion as a fulcrum.

9. The slide adjusting device as claimed in claim 8, wherein the fixture comprises a first fixing portion and a second fixing portion, a connecting member being provided between the first fixing portion and the second fixing portion, the first rail member further comprising a first end portion and a pair of side walls, the connecting member holding against inner sides of the pair of side walls at the first end portion of the first rail member, each of the side walls comprising a stop portion, a second channel being defined between the stop portion and the connecting member.

10. The slide adjusting device as claimed in claim 8, wherein the first engaging portions and the second engaging portions are gear teeth to mesh with each other.

11. A slide adjusting device, comprising:

a first rail member, having a first opening;

a fixture, secured to the first rail member, the fixture comprising a connecting surface, the connecting surface comprising a plurality of first engaging portions;

a supporting member, comprising a connecting portion, a supporting portion, and a guiding portion, the connecting portion being connected to the first rail member, the supporting portion corresponding in position to the first opening of the first rail member, the guiding portion corresponding in position to the supporting portion, the guiding portion comprising a guiding surface, the guiding surface having a first guiding end and a second guiding end opposite to the first guiding end, the first guiding end and the second guiding end having different vertical distances in relation to the first rail member; and an adjusting member, comprising an adjusting portion and a connecting rod driven by the adjusting portion, the connecting rod having two ends each provided with a plurality of second engaging portions for meshing with the first engaging portions of the connecting surface, the connecting rod corresponding to the guiding surface, when the adjusting portion is turned by a user, the second engaging portions at the two ends of the connecting rod moving and meshing with the first engaging portions of the connecting surface, the connecting rod holding against the guiding portion of the supporting member, the supporting portion of the supporting member moving in relation to the first opening of the first rail member with the connecting portion as a fulcrum.

12. A slide adjusting device, comprising:

a first rail member, having a first opening;

a fixture, secured to the first rail member;

a supporting member, comprising a connecting portion, a supporting portion, and a guiding portion, the connecting portion being connected to the first rail member, the supporting portion corresponding in position to the first opening of the first rail member, the guiding portion corresponding in position to the supporting portion, the guiding portion comprising a guiding surface, the guiding surface being formed with a plurality of first engaging portions, the guiding surface having a first guiding end and a second guiding end opposite to the first guiding end, the first guiding end and the second guiding end having different vertical distances in relation to the first rail member; and an adjusting member, comprising an adjusting portion and a connecting rod driven by the adjusting portion, the adjusting portion being adapted for a user to operate, the connecting rod being provided with a plurality of second engaging portions for meshing with the first engaging portions of the supporting member, when the adjusting portion is turned by the user, the second engaging portions of the connecting rod moving and meshing with the first engaging portions of the supporting member, the supporting portion of the supporting member moving in relation to the first opening of the first rail member with the connecting portion as a fulcrum.

* * * * *